US007594647B2

(12) United States Patent
DeVore et al.

(10) Patent No.: US 7,594,647 B2
(45) Date of Patent: Sep. 29, 2009

(54) PICK MECHANISM WITH STACK HEIGHT DEPENDENT FORCE FOR USE IN AN IMAGE FORMING DEVICE

(75) Inventors: Benjamin C. DeVore, Lexington, KY (US); Darin M. Gettelfinger, Lexington, KY (US); Paul Douglas Horrall, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 212 days.

(21) Appl. No.: 11/221,506

(22) Filed: Sep. 8, 2005

(65) Prior Publication Data

US 2007/0052153 A1 Mar. 8, 2007

(51) Int. Cl.
*B65H 5/00* (2006.01)

(52) U.S. Cl. ..... 271/10.09; 271/117

(58) Field of Classification Search ..... 271/10.09, 271/21, 109, 117

See application file for complete search history.

(56) References Cited

U.S. PATENT DOCUMENTS

| | | | | | |
|---|---|---|---|---|---|
| 4,925,062 | A | | 5/1990 | Tsukamoto et al. | |
| 4,934,684 | A | * | 6/1990 | Gysling | 271/34 |
| 5,201,508 | A | | 4/1993 | Kuo | |
| 5,203,552 | A | * | 4/1993 | Hoshi et al. | 271/9.01 |
| 5,328,163 | A | | 7/1994 | Yamada | |
| 5,348,282 | A | | 9/1994 | Choi et al. | |
| 5,368,285 | A | | 11/1994 | Kusumoto | |
| 5,390,016 | A | * | 2/1995 | Hoshi et al. | 399/371 |
| 5,485,991 | A | | 1/1996 | Hirano et al. | |
| 5,527,026 | A | | 6/1996 | Padget et al. | |
| 5,842,694 | A | | 12/1998 | Brooks et al. | |
| 5,868,385 | A | * | 2/1999 | Embry et al. | 271/118 |
| 5,899,450 | A | * | 5/1999 | Gettelfinger et al. | 271/121 |
| 5,927,703 | A | | 7/1999 | Endo | |
| 5,932,313 | A | * | 8/1999 | Barton | 428/141 |
| 5,951,002 | A | | 9/1999 | Yokota | |
| 6,139,007 | A | * | 10/2000 | Cahill et al. | 271/121 |
| 6,237,909 | B1 | | 5/2001 | Carter, Jr. et al. | |
| 6,267,369 | B1 | | 7/2001 | Regimbal et al. | |
| 6,378,858 | B1 | | 4/2002 | Suga | |
| 6,382,619 | B1 | | 5/2002 | Gustafson et al. | |
| 6,390,463 | B1 | * | 5/2002 | Iwago | 271/118 |
| 6,554,270 | B2 | | 4/2003 | Yamamoto | |
| 2004/0245704 | A1 | * | 12/2004 | Hall et al. | 271/117 |
| 2004/0251592 | A1 | * | 12/2004 | Ruhe et al. | 271/109 |
| 2005/0023745 | A1 | * | 2/2005 | Morimoto et al. | 271/117 |

* cited by examiner

*Primary Examiner*—Patrick H Mackey
*Assistant Examiner*—Michael C McCullough
(74) *Attorney, Agent, or Firm*—David D. Kalish; Coats & Bennett PLLC

(57) ABSTRACT

Embodiments of a pick mechanism for use in an image forming device. In one embodiment, a first mechanism individually moves each of the media sheets from a stack in the input area thereby gradually decreasing a height of the stack. The first mechanism applies a first force profile to the stack while individually moving each of the plurality of media sheets. As the media sheets are moved, the height of the stack gradually decreases from a first height to a second height. As the stack decreases below the second height, a second force profile is applied to the stack. The second force profile is different from the first profile. The first and second force profiles prevent slip as the media sheets are fed from the input area, and also prevent double sheet feeds.

10 Claims, 5 Drawing Sheets

PICK MECHANISM WITH STACK HEIGHT DEPENDENT FORCE FOR USE IN AN IMAGE FORMING DEVICE

BACKGROUND

Media sheets for use in an image forming device are initially stored in an input area. The input area is sized to hold a predetermined number of media sheets that are stacked together. A pick mechanism is positioned adjacent to the input tray to pick individual media sheets from the stack and deliver them into a media path. The pick mechanism should accurately deliver one sheet from the input area, and should deliver the sheet in a timely manner.

The pick mechanism includes a pivoting arm having a pick roller at the distal end. The pick roller rests on the stack and rotates to drive the top-most sheet from the stack into the media path. The arm applies a downward force onto the media stack. This force applied through the roller increases the friction between the roller and top-most sheet such that the sheet is delivered to the media path by rotation of the roller.

One prior art device limited the amount of force applied to the media stack. A drawback of applying a limited force is that the roller may slip during rotation. Roller slip causes a delay in picking the media sheet from the stack and introducing the sheet into the media path. This delay may cause print errors as the toner image is not accurately aligned with the top edge of the media sheet.

Another prior art device increased the amount of force applied to the media sheet to prevent roller slip. However, increased force caused the pick roller to move multiple sheets from the media stack into the media path. This double feed results in a media jam as the combined sheets cannot be moved as a unit through the device. The jam required the operator to locate the jam, remove the media sheets, reset the device, and then resume image formation.

SUMMARY

The present application is directed to embodiments of a pick mechanism for use in an image forming device. In one embodiment, a first mechanism individually moves each of the media sheets from a stack in the input area thereby gradually decreasing a height of the stack. The first mechanism applies a first force profile to the stack while individually moving each of the plurality of media sheets. As the media sheets are moved, the height of the stack gradually decreases from a first height to a second height. As the stack decreases below the second height, a second force profile is applied to the stack. The second force profile is different from the first profile. The first and second force profiles prevent slip as the media sheets are fed from the input area, and also prevent double sheet feeds.

DETAILED DESCRIPTION

Figure 1:
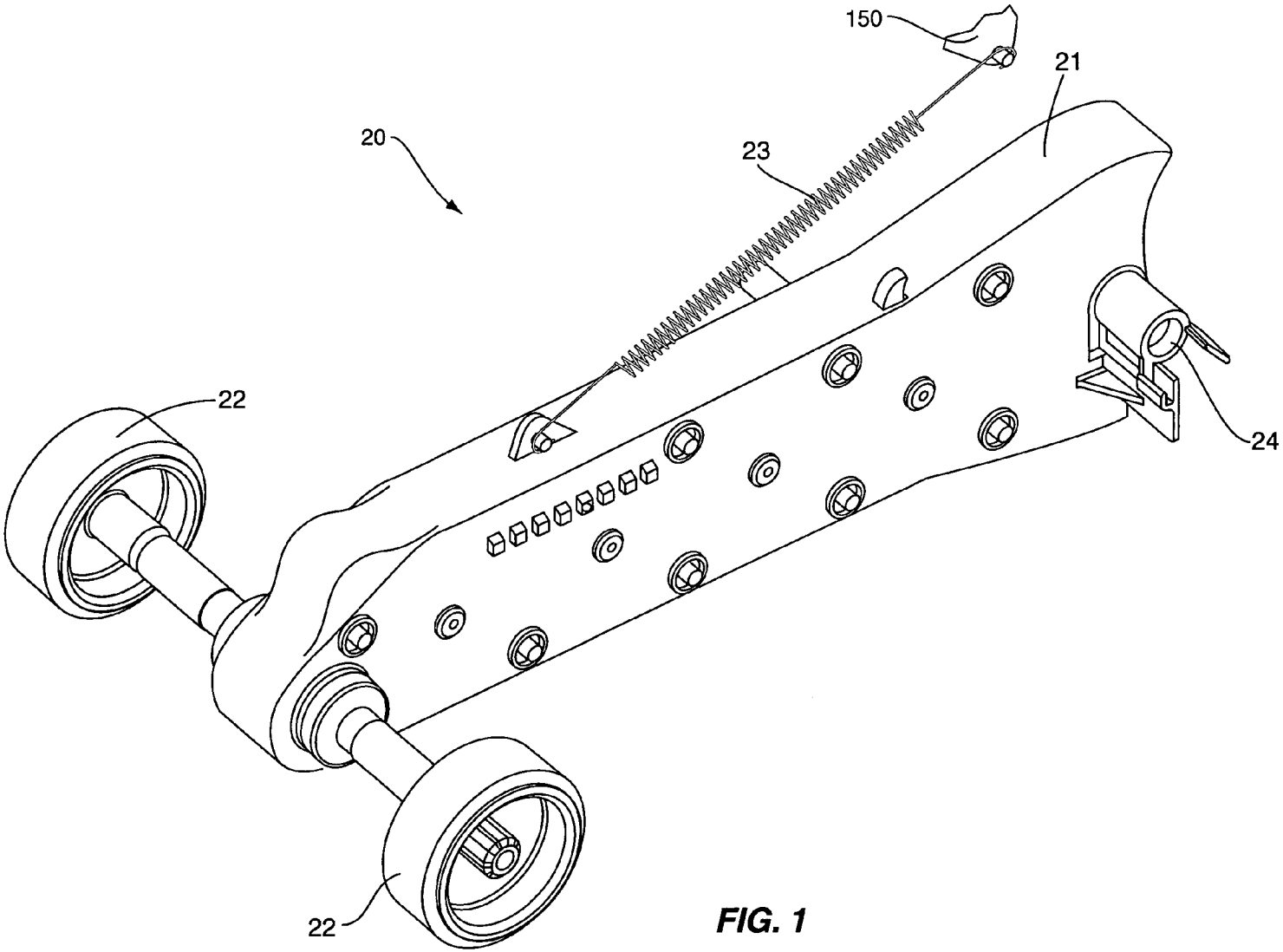
FIG. 1 is a perspective view illustrating a pick mechanism according to one embodiment of the present invention.

The present application is directed to embodiments of a pick mechanism for applying a force to a media sheet within an image forming device. The pick mechanism, generally illustrated as numeral 20 in FIG. 1, includes a pick arm 21, pick roller 22, and a biasing mechanism 23. The pick arm 21 is pivotally positioned at point 24 such that the pick rollers 22 rest on a top-most media sheet within a stack. The pick arm 21 applies a downward force onto the media stack. When the media stack is above a predetermined level, a first amount of force is applied to the stack. As the media stack decreases, the arm 21 pivots about point 24. The biasing mechanism 23 engages and applies a force thereby reducing the force applied by the pick arm 21.

Figure 2:
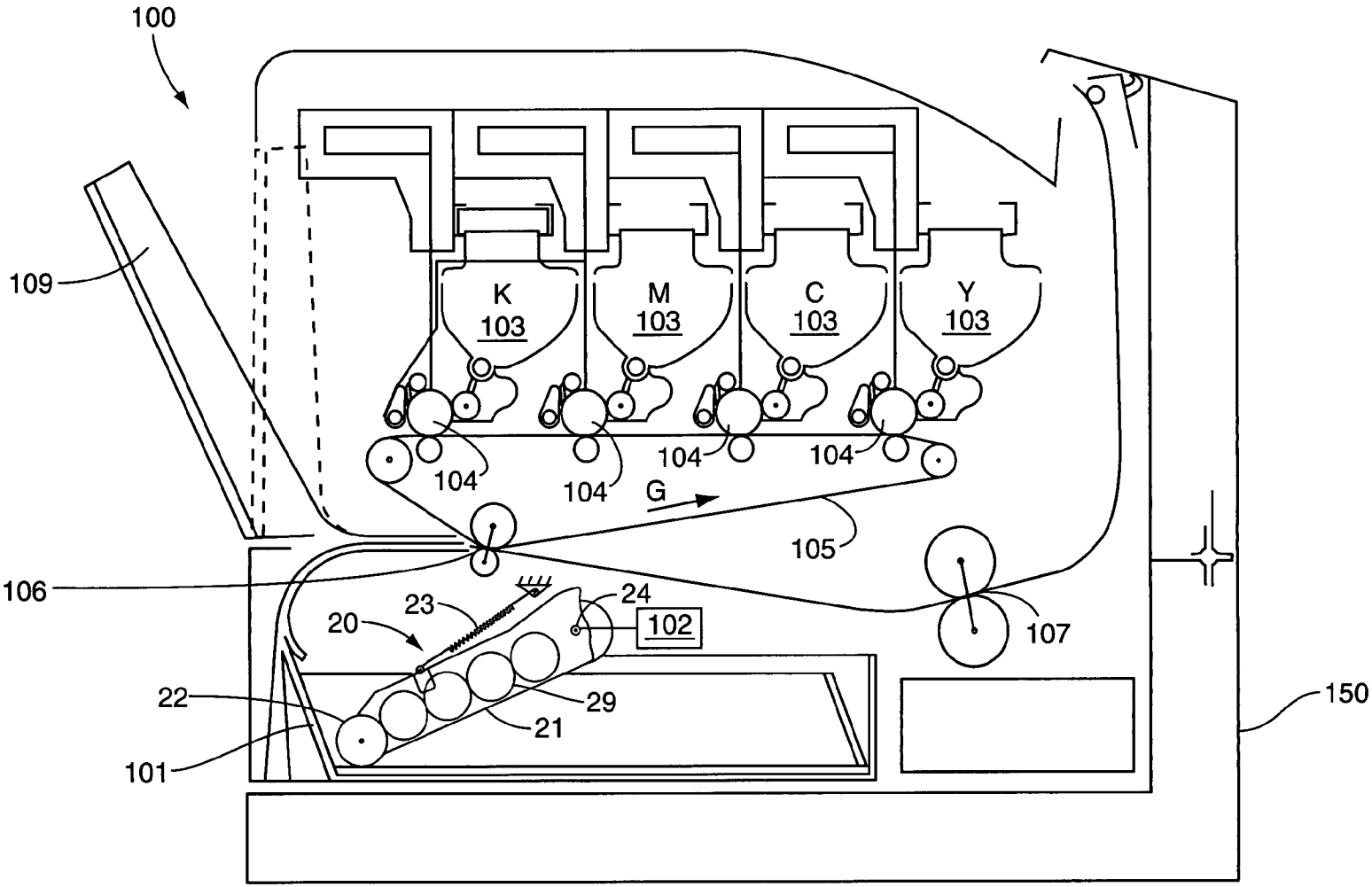
FIG. 2 is a schematic view illustrating an image forming device according to one embodiment of the present invention.

The pick mechanism 20 is positioned within an image forming device 100 as illustrated in FIG. 2. An input tray 101 is sized to contain a stack of media sheets. The pick mechanism 20 is positioned with the pick roller 22 resting on the top-most sheet of the stack. A drive mechanism 102 is operatively connected to a gear train 29 extending through the arm 21 that causes rotation of the pick rollers 22. Rotation causes the top-most sheet to be moved from the stack and into the media path.

The device 100 includes a plurality of removable image formation cartridges 103, each with a similar construction but distinguished by the toner color contained therein. In one embodiment, the device 100 includes a black cartridge (K), a magenta cartridge (M), a cyan cartridge (C), and a yellow cartridge (Y). Each cartridge 103 includes a reservoir holding a supply of toner, a developer roller for applying toner to develop a latent image on a photoconductive drum, and a photoconductive (PC) member 104. Each cartridge 103 forms an individual monocolor image on the PC member 104 that is combined in layered fashion on an intermediate transfer mechanism (ITM) belt 105. The ITM belt 105 is endless and rotates in the direction indicated by arrow G around a series of rollers adjacent to the PC members 104. Toner is deposited from each PC member 104 as needed to create a full color image on the ITM belt 105. The ITM belt 105 and each PC drum 104 are synchronized so that the toner from each PC drum 104 precisely aligns on the ITM belt 105 during a single pass.

As the toner images are being formed on the ITM belt 105, the pick mechanism 20 picks a media sheet from the input tray 101. The media sheet is transported to a transfer location 106 where it intersects the toner images on the ITM belt 105. The sheet and attached toner next travel through a fuser 107 having a pair of rollers and a heating element that heats and fuses the toner to the sheet. The sheet with fused image is then either transported out of the device 100, or forwarded to a duplex path for image formation on a second side of the media sheet.

The pick mechanism 20 should accurately introduce the media sheet into the media path. Too much force applied to the media stack by the pick mechanism may cause a double feed resulting in a media jam as the media sheets move into or along the media path. Too little force applied to the media stack by the pick mechanism 20 may result in the pick rollers 22 slipping on the top-most sheet. Slipping causes the media sheet to be delayed in the input tray 101 and delivered late to the media path and ultimately to the transfer location 106. As a result, the media sheet does not align with the toner images on the ITM belt 105. In one embodiment, the toner images are transferred to the media sheet too close to the leading edge (i.e., the toner images are not centered on the media sheet). Therefore, proper operation of the pick mechanism 20 is important.

Figure 3:
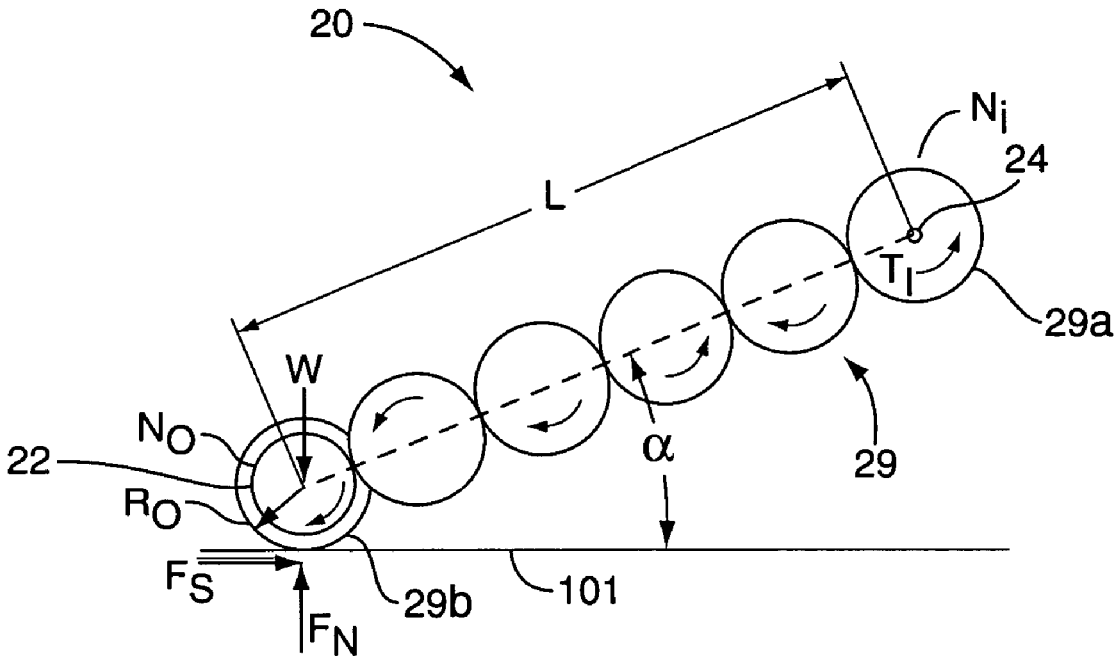
FIG. 3 is a schematic view illustrating the pick mechanism according to one embodiment of the present invention.

The force applied by the pick mechanism 20 is a function in part of the weight of the pick mechanism 20, and the angle of the pick arm 21. FIG. 1 illustrates a perspective view of one embodiment of the pick mechanism 20, and FIG. 3 illustrates a schematic illustration. The arm 21 is pivotally positioned within the device 100 at a pivotal attachment 24. The arm 21 is positioned adjacent to the input tray 101 for the rollers 22 to remain in contact with the top-most media sheet in the stack. The arm 21 forms an angle α with a plane formed by the top-most media sheet. When the input tray 101 is full of stacked media, the angle α is small or even zero if the arm is parallel to the top-most sheet. The angle α increases as the stack is depleted.

A gear train 29 extends through the arm 21 and includes an input gear 29*a* (i.e., first gear) and an output gear 29*b* (i.e., last gear). An input torque supplied by the driving mechanism 102 is transferred through the gear train 29 ultimately causing rotation of the rollers 22. Each gear in the gear train 29 includes a number of teeth that mesh with the adjacent gears to transfer the torque and rotate the rollers 22.

The following equations govern the function of the force applied by the pick mechanism 20 to the media sheets:

$$F_s = T_i N_o (Eff^n)/N_i R_o \quad \text{(Eq. 1)}$$

$$F_N = W + [T_i + (F_s(L \sin \alpha + R_o))/L \cos \alpha] \quad \text{(Eq. 2)}$$

where $F_s$=tangential force exerted on a media sheet by the pick roller;

$T_i$=input torque to the pick arm gears from the motor;

$N_o$=number of teeth on the output gear;

Eff=gear mesh efficiency;

n=number of gear meshes;

$N_i$=number of teeth on the input gear;

$R_o$=radius of the pick roller;

$F_N$=normal force exerted on the pick roller by the media sheet;

W=normal force exerted on the media sheet by the pick roller;

L=length of the pick arm; and

α=angled formed between a plane of the top-most media sheet and the arm.

The force applied through the pick rollers 22 to the media stack is dependent upon the angle α. When the media stack is full, the force applied to the media sheets is small thus increasing the possibility of roller slippage. When the media stack is low, the force applied is greater thus increasing the possibility of double feeds. To compensate for this, the biasing mechanism 23 is attached to the arm 21.

The biasing mechanism 23 has a first end connected to the arm 21 and a second end connected to a body 150 of the device 100. The biasing mechanism 23 is extendable from a non-engaged orientation to an engaged orientation. In the non-engaged orientation, the biasing mechanism 23 does not apply an upward force to the arm 21. Once the biasing mechanism 23 engages, it applies an upward force. During the initial stages of engagement, the amount of force is not as great as during further stages of engagement. Therefore, as the angle α of the arm 21 becomes larger, the amount of force applied by the biasing mechanism 23 becomes greater. In one embodiment, the biasing mechanism 23 is a spring.

When the media stack is full and the angle α is large, the biasing mechanism 23 is not engaged. Therefore, the force applied to the media stack is defined by the above equations. However, as the media stack is depleted below a predetermined amount, the biasing mechanism 23 becomes engaged and counteracts the applied force. As the media stack becomes more depleted and the angle α becomes larger, the biasing mechanism applies a greater counteracting force. In this manner, the force applied to the media stack is regulated to prevent too great or too small of a force and prevent double feeds and roller slippage.

Figure 4:
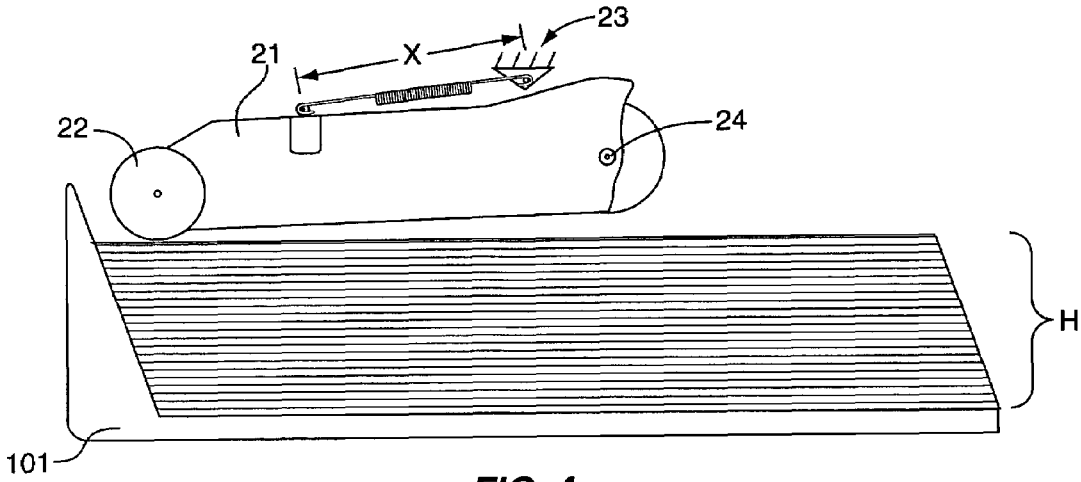
FIG. 4 is a side view illustrating the pick mechanism and a substantially full stack of media sheets within an input tray according to one embodiment of the present invention.
Figure 5:
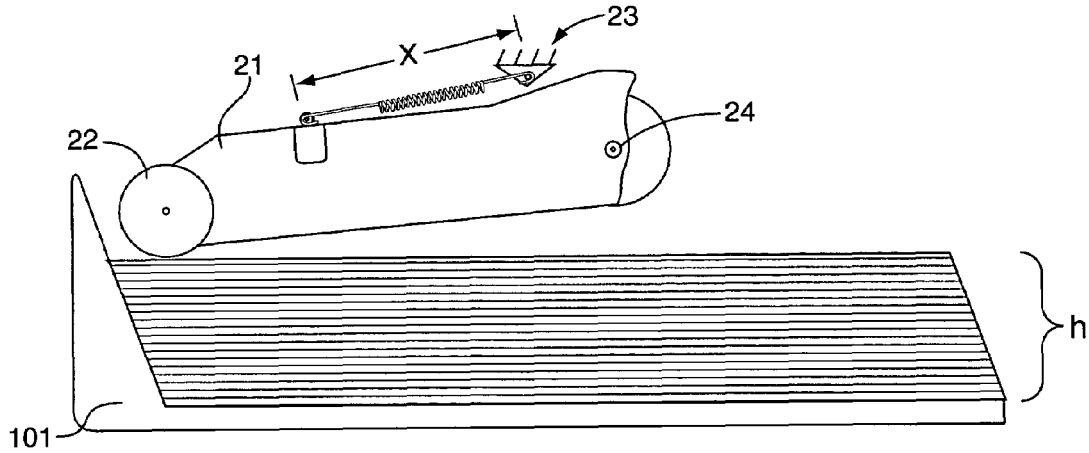
FIG. 5 is a side view illustrating the pick mechanism and a partially depleted stack of media sheets within an input tray according to one embodiment of the present invention.
Figure 6:
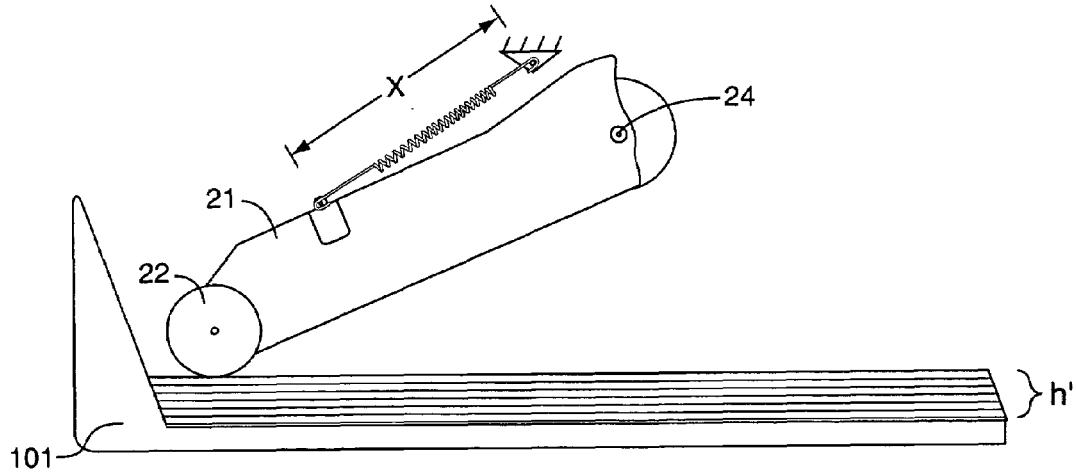
FIG. 6 is a side view illustrating the pick mechanism and a depleted stack of media sheets within an input tray according to one embodiment of the present invention.

FIGS. 4, 5, and 6 illustrate the affects of the biasing mechanism 23 as media sheets are picked from the input tray 101 and the stack height is reduced. FIG. 4 illustrates the input tray 101 accommodating a full stack of media sheets having a stack height H. The biasing mechanism 23 includes a first end attached to the arm 21 and a second end attached to the body 150. With the arm 21 being nearly horizontal, the distance x between the first and second ends of the biasing mechanism 23 is relatively small. The biasing mechanism 23 therefore has not become engaged and does not apply a counterbalance force to the arm 21. Therefore, the force applied through the roller 22 to the top-most sheet in the stack is defined by equations 1 and 2 stated above.

FIG. 5 illustrates a state when a number of sheets have been removed from the input tray 101 and the stack height reduced to height h. The arm 21 has pivoted downward with the angle α becoming larger. As a result of the pivoting action, the distance x between the first and second ends of the biasing mechanism 23 has increased. The biasing mechanism 23 is now engaged and applies a counterbalance force to the arm 21. Therefore, the overall force applied to the top-most media sheet through the rollers 22 is the force as defined in equations 1 and 2, less the counterbalance force applied by the biasing mechanism 23.

FIG. 6 illustrates a state with almost the entire stack of media sheets having been depleted from the input tray 101. The stack has been reduced to a height h'. The arm 21 has pivoted an additional amount with the distance x between the first and second ends of the biasing mechanism 23 becoming larger. This results in an additional amount of counterbalance force being applied to the arm 21.

Figure 7:
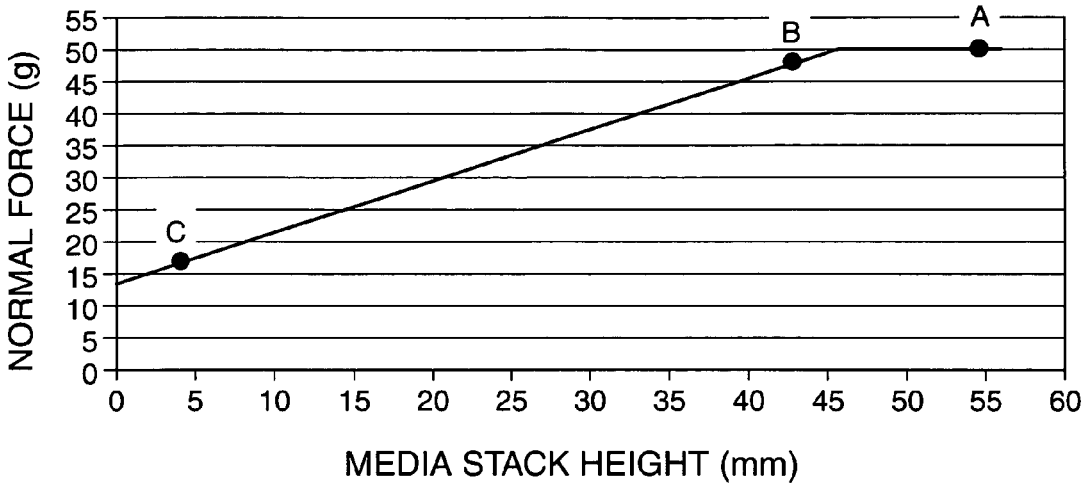
FIG. 7 is a graph illustrating a normal force applied to the media stack by the pick mechanism according to one embodiment of the present invention.

FIG. 7 illustrates the amount of normal force applied by the pick mechanism 20 to the top-most media sheet. The force is substantially constant as the media stack is depleted from a full amount to some predetermined amount. In this embodiment, the input tray 101 is able to accommodate a media stack having a height of about 55 mm. The pick mechanism 20 applies a normal force of about 50 grams until the media stack has become depleted to a height of about 45 mm. Point A indicates a substantially full stack height as discussed in the embodiment of FIG. 4.

At a stack height of about 45 mm, the biasing mechanism 23 begins to engage and apply a counterbalance force. As the stack height decreases and the angle α becomes larger, the biasing mechanism 23 applies a greater force. The overall force applied to the media sheets gradually decreases as the stack height is diminished. Point B correlates to the embodiment illustrated in FIG. 5 with a stack height of about 40 mm and a force applied of about 48 grams. Point C correlates to the embodiment illustrated in FIG. 6 with a stack height of about 5 mm and an overall force of about 17 grams.

Figure 8:
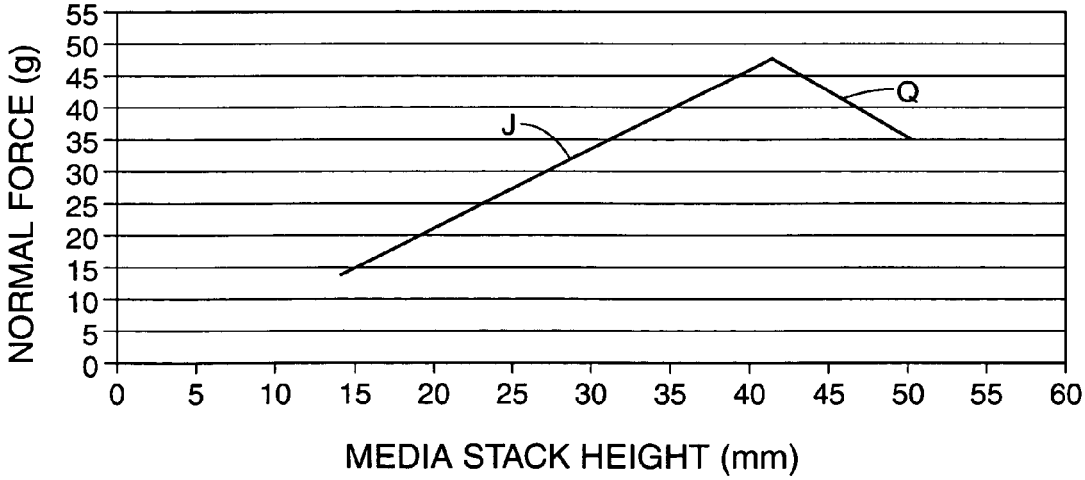
FIG. 8 is a graph illustrating a normal force applied to the media stack by the pick mechanism according to one embodiment of the present invention.

The force profiles may vary as necessary to reduce or eliminate roller slippage and double feeds. FIG. 8 illustrates another embodiment. During the first profile Q the media sheets are depleted but the biasing mechanism 23 does not become engaged. During this depletion, the angle $\alpha$ of the arm 21 is increasing and thus the force applied to the media sheets increases. At some predetermined height, the biasing mechanism 23 becomes engaged and begins to offset the force applied by the arm 21. This is illustrated in profile J. The point where the biasing mechanism 23 engages, and the amount of force applied at each height may vary depending upon the application.

In the embodiment illustrated in FIG. 1, two rollers 22 are positioned towards an end of the pick arm 21. Various numbers and sizes of rollers 22 may be used again depending upon the application.

The term "image forming device" and the like is used generally herein as a device that produces images on a media sheet. Examples include but are not limited to a laser printer, ink-jet printer, fax machine, copier, and a multi-functional machine. Examples of an image forming device include Model Nos. C750 and C752 available from Lexmark International, Inc. of Lexington, Ky.

The embodiments illustrated in FIGS. 2, 4, 5, and 6 illustrate the input area comprising an input tray 101 having a bottom and side walls sized to contain the sheets. The input area may also include a manual feed area 109 where the media sheets are placed in a stacked orientation that are fed into the media path.

These embodiments may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A device to move media sheets within an image forming apparatus, the device comprising:

an input area sized to hold a stack of the media sheets, the input area including a support floor;

an arm having a moveable first end and a second end, the arm pivotally connected to the image forming apparatus adjacent to the second end with the second end spaced a fixed distance from the support floor and being spaced a greater distance from the support floor than the movable first end such that the arm forms acute angles with the support floor, the arm applying a downward force to the stack;

a roller operatively connected to the movable first end of the arm and positioned to remain in contact with a top-most media sheet of the stack to individually move each of the media sheets from the input area;

a mechanism including a first end connected to the arm and a second end connected to the image forming apparatus, the mechanism operable in;

a first state corresponding to the first end of the arm being positioned above a predetermined height in the device such that the distance between the first and the second ends of the mechanism is less than a predetermined length and the mechanism provides substantially no upward forces on the arm;

a second state corresponding to the first end of the arm being positioned at the predetermined height in the device such that the distance between the first and second ends of the mechanism being substantially equal to the predetermined length such that the mechanism engages the arm to exert a counterbalance force on the arm of a first force amount; and a third state corresponding to the first end of the arm being positioned below the predetermined height in the device and the and the distance between the first and the second ends of the mechanism being greater than the predetermined length such that the mechanism engages the arm to exert the counterbalance force on the arm of an amount greater than the first force amount, the arm and mechanism exerting an overall downward force to media sheets in the input area at a first overall force amount while the mechanism is in the first state, and at a second overall force amount that is less than the first overall force amount while the mechanism is in the second and third states, the overall downward force gradually decreasing as the first end of the arm decreases from the predetermined height, the predetermined height corresponding to a height of a stack of media sheets that is less than a maximum number of sheets maintained in the input area.

2. The device of claim 1, wherein the arm further comprises a gear train that transfers rotational power from a motor within the image forming apparatus to the roller.

3. The device of claim 1, wherein the overall downward force applied to the media sheets decreases in a linear manner.

4. The device of claim 1, wherein the overall downward force applied to the media sheets is constant when the stack is above the predetermined height.

5. The device of claim 1, wherein an overall downward force is 50 grams when the media stack is above the predetermined height.

6. A device to move media sheets within an image forming apparatus, the device comprising:

an input area sized to hold a stack of the media sheets, the input area including a support floor;

an arm including a first end and a second end, the second end being fixedly attached to the image forming apparatus with the arm configured to pivot about the second end with the first end remaining in contact with a top-most sheet of the stack as the stack is depleted; and a biasing mechanism including a first end connected to the arm and a second end connected to the image forming apparatus, the biasing mechanism exerting substantially no force on the arm while the first end of the arm is above a first height in the image forming apparatus and exerts a non-zero force on the arm while the first end thereof is at or below the first height, the non-zero force gradually increasing as a distance between the first height and the first end of the arm increases such that the overall force applied to a stack of media in the input area gradually decreases as the distance increases, the first height corresponding to a height of the stack of media sheets that is less than a maximum amount that can be maintained in the input area.

7. The device of claim 6, wherein an overall force applied to the stack is constant while the stack decreases from the maximum amount to the first height.

8. The device of claim 6, wherein the arm further comprises a rotating roller, the roller contacting the top-most sheet and rotating to move the top-most out of the input area.

9. The device of claim 6, wherein the biasing mechanism comprises a spring that is attached to the arm and applies an upward force to the arm.

10. A device to move media sheets within an image forming apparatus, the device comprising:

an input area sized to hold a stack of the media sheets, the input area including a support floor;

an arm including a first end that includes a roller and a second end that is connected to the image forming apparatus, the arm being able to pivot about the second end with the roller positioned to remain in with a top-most sheet of the stack as the stack is depleted, the second end remaining positioned a greater distance from the support floor than the first end as the arm pivots about the second end; and a biasing mechanism including a first end connected to the arm and a second end connected to the image forming device, the biasing mechanism positionable between a disengaged orientation with the first and second ends positioned less than a predetermined distance apart with the biasing mechanism in a non-stretched configuration, and an engaged orientation with the first and second ends positioned greater than the predetermined distance apart with the biasing mechanism in a stretched configuration;

wherein the biasing mechanism is in the disengaged orientation while the first end of the arm is above a predetermined height in the device and applies substantially no force on the arm, and is in the engaged orientation while the first end of the arm is at or below the predetermined height and applies a force on the arm, the applied force increasing as a distance between the predetermined height and a position of the first end of the arm increases, the predetermined height corresponding to stack of media sheets that is less than a maximum amount that can be maintained in the input area.

* * * * *